United States Patent [19]

Gustavus

[11] 4,450,935

[45] May 29, 1984

[54] PORTABLE ADJUSTABLE ROOF PLATFORM

[76] Inventor: David C. Gustavus, 1609 Dondor Dr., Fond du Lac, Wis. 54935

[21] Appl. No.: 453,533

[22] Filed: Dec. 27, 1982

[51] Int. Cl.[3] ..... E04G 3/12; E06C 7/16

[52] U.S. Cl. ..... 182/45; 182/121; 248/237

[58] Field of Search ..... 182/45, 121, 117, 122; 254/126, 9 C, 9 R, 98, 88; 248/237, 210, 238

[56] References Cited

U.S. PATENT DOCUMENTS

| | | | |
|---|---|---|---|
| 230,425 | 7/1880 | Langmaid | 248/237 |
| 467,081 | 1/1892 | Church | 182/151 |
| 524,661 | 8/1894 | Austin | 182/45 |
| 955,159 | 4/1910 | Hillmon | 182/45 |
| 2,320,538 | 6/1943 | Vogt | 248/237 |
| 2,419,727 | 4/1947 | Picone | 182/121 |
| 2,549,638 | 4/1951 | Rogghe | 248/237 |
| 2,848,282 | 8/1958 | Weber | 182/45 |
| 3,067,836 | 12/1962 | Carnicelli | 182/121 |
| 3,164,353 | 1/1965 | Rene | 248/237 |
| 3,866,715 | 2/1975 | Foulk | 182/45 |
| 3,892,132 | 7/1975 | Coton | 254/126 |
| 4,132,287 | 1/1979 | Parolini | 182/45 |
| 4,161,232 | 7/1979 | Bustin | 182/222 |

FOREIGN PATENT DOCUMENTS

| | | | |
|---|---|---|---|
| 5667 | 5/1979 | European Pat. Off. | 182/45 |
| 926632 | 4/1955 | Fed. Rep. of Germany | 182/45 |

*Primary Examiner*—Reinaldo P. Machado
*Attorney, Agent, or Firm*—Donald Cayen

[57] ABSTRACT

A portable adjustable roof platform for use with a roof ladder so as not to damage a sloped roof surface. The roof platform may be quickly engaged with the roof ladder and adjusted to the horizontal position without handling small locating or fastening parts. The roof platform folds into a compact closed configuration for ease of transportation.

4 Claims, 3 Drawing Figures

PORTABLE ADJUSTABLE ROOF PLATFORM

BACKGROUND OF THE INVENTION

1. Field of the Invention

This invention pertains to roof platforms, and more particularly to portable and readily adjustable roof platforms that do not damage the roof surface.

2. Description of the Prior Art

The purpose of a roof platform is to provide a relatively horizontal surface on which a person may comfortably stand while working on a sloped roof. To that end, several designs of adjustable roof platforms have been developed. U.S. Pat. Nos. 955,159; 2,320,538; and 3,866,715 are examples of swingable platforms that lock in discrete positions by means of pins and corresponding holes. Each of the above three patented platforms utilizes spikes or barbs which imbed into the roof to hold the platform in place. Using a spiked holding means is undesirable on asphalt and shake roofs because of potential damage to the roofing material. Furthermore, spiked holding means are not suitable for slate roofs. U.S. Pat. No. 3,164,353 discloses a roof bracket that is infinitely adjustable through its range. The bracket is secured to the roof by nailing plates and nails. The disadvantages of nailing the bracket to a finished roof are apparent.

In addition to not damageing the roof surface, a desireable feature of a roof platform is ease of operation. In some applications, time and weather conditions impose severe constraints on the set-up procedures of a roof platform. For example, fire-fighting personnel require a platform that may quickly be put in to use in all kinds of weather. Moreover, the platform must be rapidly and conveniently operated by personnel wearing heavy mittens. A roof platform that rests on the rungs of a roof ladder does not damage a finished roof. U.S. Pat. No. 2,848,282 illustrates a platform that is supported by a roof ladder. However, rapid and efficient set-up of the 2,848,282 platform is precluded because of the necessity of loosening and tightening or otherwise handling relatively small fasteners, which may easily be lost under adverse conditions. Thus, a need exists for an adjustable roof platform that does not damage a completed roof and that can be employed quickly and safely under emergency conditions.

SUMMARY OF THE INVENTION

The present invention provides an adjustable roof platform that is easily and rapidly adjustable through its range and that does not damage the roof. The adjustable roof platform includes a base which is adapted to engage the rungs of a roof ladder. To accomplish that purpose, the base incorporates at least one notch, which may be shaped in the form of an L, to hook onto a ladder rung to positively and safely secure the platform to the ladder. As adjustable step is pivotably connected to the base. Pivotable adjustment of the step relative to the base is accomplished by a toggle mechanism actuated by toggle actuating means, which may comprise a screw and thrust bearing arrangement. The screw may be rotated by means of a handle located in a convenient and accessable location. The step is preferrably pivotable relative to the base from a parallel side-by-side relation through an angle of about 45°.Further important features include light weight, a slip-proof step surface, and convenient portablity.

BRIEF DESCRIPTION OF THE DRAWINGS

While the specification concludes with claims particularly pointing out and distinctly claiming the subject matter regarded as forming the present invention, it is believed this invention will be better understood from the following detailed description taken in connection with the accompanying drawings, in which:

DETAILED DESCRIPTION OF THE INVENTION

Figure 1:
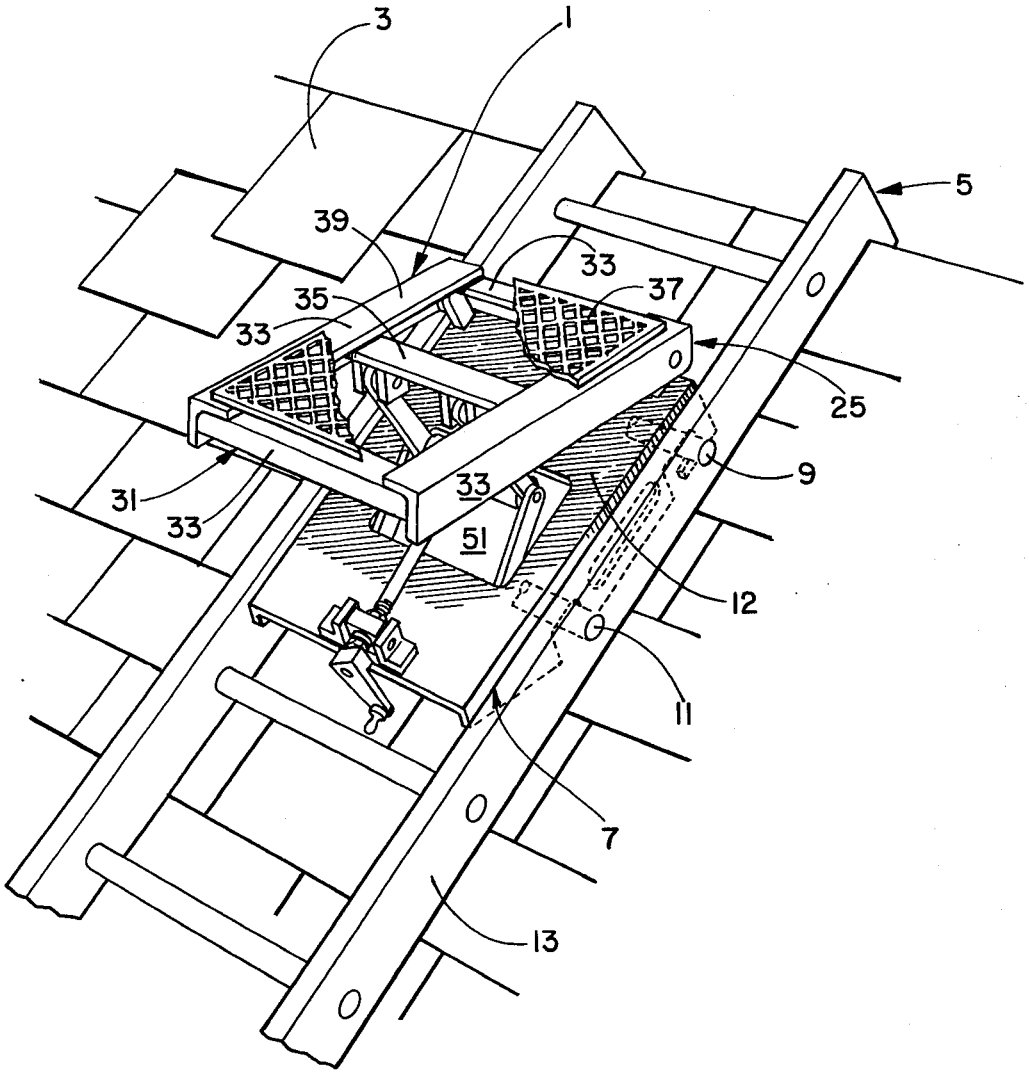
FIG. 1 is a perspective view of the portable adjustable platform of the present invention in operative position on a roof ladder.

Referring to FIG. 1, reference numeral 1 indicates the portable adjustable roof platform of the present invention. In the illustrated embodiment, the platform is designed for use on sloped roofs, such as shown at 3, having pitches of up to about 45° with the horizontal. Reference numeral 5 represents a roof ladder conventionally constructed for the task at hand. For example, the roof ladder may be of the type commonly employed by fire-fighting personnel wherein spring actuated hooks engage the apex of the roof. It will be understood, however, that the use of the roof platform of the present invention is not limited to a particular occupation. For instance, the present platform is eminently suitable for carpenters working on building dormers.

In accordance with the present invention, the roof platform includes a base 7 adapted to engage rungs 9, 11 of the ladder 5. The base is preferably constructed of a generally U-shaped member having a flat frame portion 12 and a pair of downwardly extending support walls 14. It is anticipated that the platform will be employed with commonly used roof ladders having a relatively standard construction. Thus, it is expected that the depth of the ladder rails 13, the spacing between the rails, the diameter of the rungs, and spacings between the rungs will lie within relatively narrow ranges. A single width between the walls 14 and a single height of the walls should therefore suit the great majority of ladders commonly used on roofs.

Figure 2:
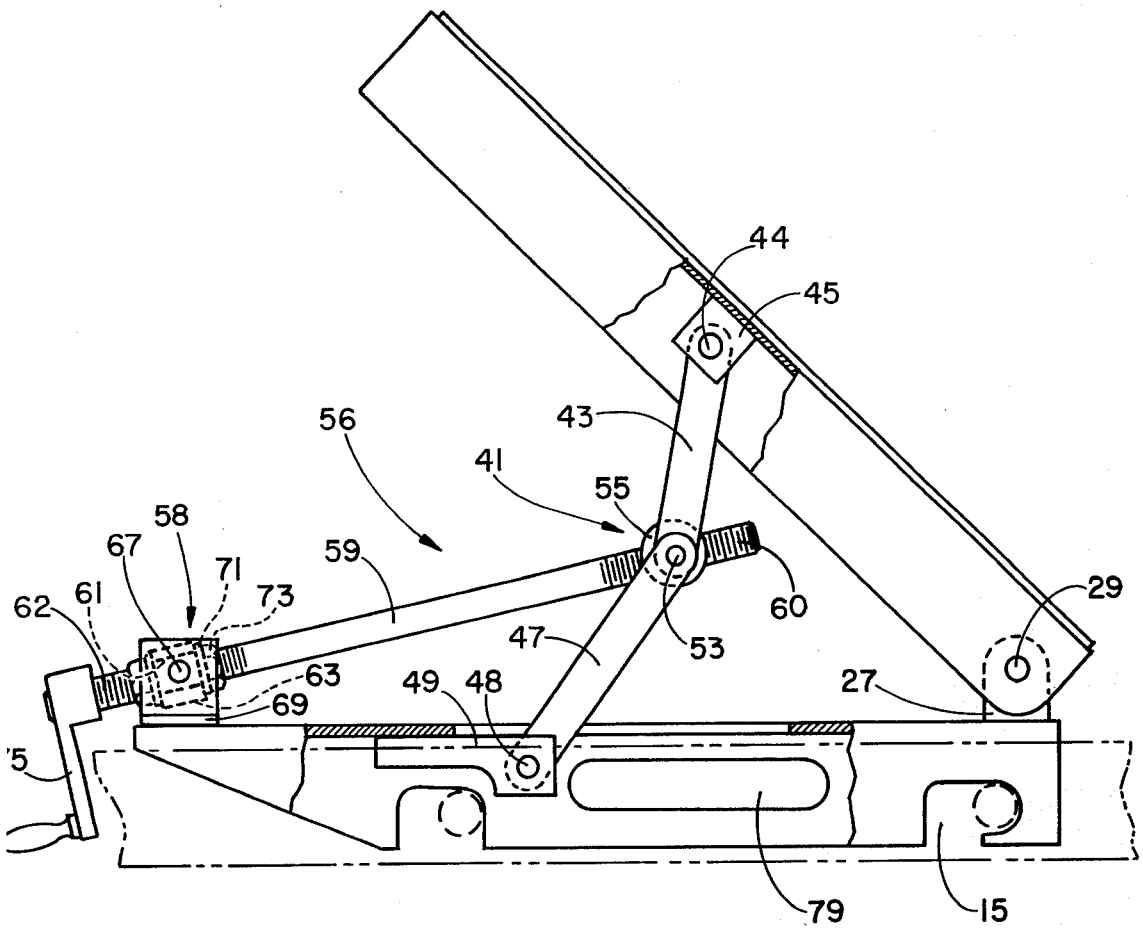
FIG. 2 is a side view, partially broken, of the roof platform in an opened position.

To securely lock the base 7 onto the ladder rung 9, each support wall is formed with at least one notch, which is preferably L-shaped as indicated by reference numeral 15, FIG. 2. Upper surfaces 17 of notches 15 are preferrably of semi-circular shape, FIG. 3. The width of notch opening 21 and the diameter of upper surface 17 are sized to accommodate most ladder rungs; a dimension of about 1.50 inches in both instances is considered satisfactory. It is readily apparent that the weight of the platform as well as a person standing on it will tend to increase the engaging force of the base onto the ladder. To support the lower end 18 of the platform on ladder rung 11, the walls 14 may be formed with lower notches 19, which may be of a generally rectangular shape. The spacing between the openings 21 and the lower portions 22 of notches 19 may be about 14 inches, as that dimension will accommodate a standard spacing between adjacent rungs 9, 11. This and other dimensions specified herein are not considered to be critical. Indeed, although the invention is described in connection with a preferred embodiment, it will be understood that it is not intended to limit the invention to that embodiment.

On the contrary, it is entended to cover all alternatives, modifications, and equivalents as may be included within the spirit and broad scope of the invention as defined in the appended claims.

Pursuant to the invention, lower surfaces 23 of the support walls 14 are preferrably spaced only a slight distance, perhaps on the order of 0.25 inches, from the roof when the base is in place on a ladder. The reason for the minimal spacing will be fully explained hereinafter.

To provide a working surface for use on a pitched roof, the adjustable platform of this invention includes a step 25, FIG. 1. In the particular platform illustrated, the step is fabricated as a generally rectangular frame 31. The frame is preferrably composed of suitable angles 33 together with a center support 35, as that design provides adequate strength with minimum weight. The preferrably employs a slip-proof working surface. For light weight, this is accomplished in the present instance by securing an expanded metal grating 37 to the top of the frame angles 33. Any suitable securing means, such as welding, may be used to fabricate the angles, support bar, and grating into a rigid unitary structure.

For allowing pivotable motion of step 25 relative to the base 7, the base may be constructed with a pair of vertical lugs 27, FIG. 2. Suitable coaxial pins 29 fixed within the lugs rotatively couple corresponding holes in the frame 31. To raise and lower the step relative to the base, the present invention incorporates a toggle mechanism 41. The toggle mechanism includes a pair of upper links 43. Each upper link is rotatably connected at its upper end by a pin 44 to a lug 45 projecting downwardly from the support bar 35. Each of the pair of lower links 47 is rotatably connected at its lower end by a pin 48 to a bracket 49 in the base. The lower links pass through a suitable opening 51 in the flat frame portion 12. The lower end of each upper link is mounted onto a hub 53 of a support bar 55 adjacent to the upper end of the corresponding lower link. Cotter pins, not shown, may be utilized to hold the links on the support bar.

Further in accordance with the present invention, the toggle mechanism is actuated by a toggle actuating means 56. The toggle actuating means may be any suitable device, such as a piston and cylinder arrangement. In the preferred embodiment, the toggle actuating means includes an elongated screw 59 and supporting structure 58. The upper end 60 of the screw engages corresponding threads in the support bar 55. The lower end 62 of the screw is supported for rotation in a journal 61 formed in bearing block 63. The bearing block may be be formed with a pair of opposed cylindrical hubs. 67. The hubs are rotatably supported in cooperating apertures in a pair of bearing supports 69. The bearing supports may be fastened to the base 7 by any appropriate method. The lower end of the screw, which is supported in the journal 61, is preferrably threaded. Washers 71 may be interposed between the bearing block and a pair of nuts 73 threaded onto the screw on either side of the bearing block, thus forming a pair of opposed thrust bearings. The illustrated toggle actuating means constitutes a non-overriding structure. The screw does not rotate to lower the step 25 when weight is applied to the step. Override is prevented by employing a screw having a diameter of about 0.75 inches and having about 12 threads per inch. To turn the screw and thereby actuate the toggle mechanism, a handle 75 of conventional construction may be permantently attached to the lower end of the screw by suitable means, such as a pin, not shown.

Figure 3:
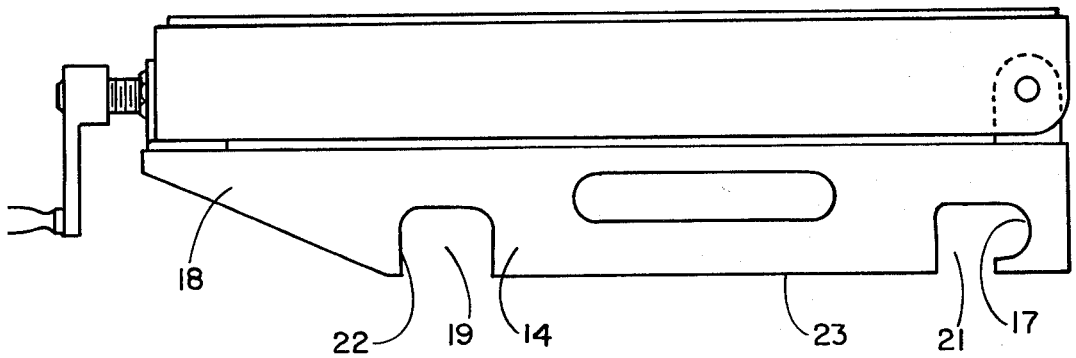
FIG. 3 is a side view of the roof platform in the closed position.

One of the features of the present invention is that it is readily transportable. For that purpose, the base 7, step 25, connecting links 43 and 47, bearing supports 69, and bearing block 63 are preferrably fabricated from aluminum. To further enhance portability, the support walls 14 may be constructed with generally oval openings 79. The openings serve as hand-holds, and they may be sized to accomodate a mittened hand. For ease of storage as well as transportation, the platform fully folds so that the base and the step lie in parallel side-by-side relationship, as shown in FIG. 3. As a result of the ease with which the instant roof platform may be carried, it is anticipated that a fire-fighter can easily carry it to a roof on the first response. Normally, a second fire-fighter would carry and set up the roof ladder.

To use the adjustable roof platform of the present invention, it will be assumed that the platform is carried to the roof in the closed position. Openings 21 of notches 15 are placed over a selected ladder rung, as at 9. The platform is lowered onto the rung, and then it is slid along the rung until the upper surface 17 engages the rung. Simultaneously, the lower notch 19 is lowered onto and slid along rung 11. Handle 75 is then rotated so that support bar 55 moves linearly toward the upper end 60 of the screw 59, thus causing the links 43, 47 to open the step 25 relative to the base 7. Rotating the handle in the opposite direction will cause the step to close. It is manifest that the platform of the present invention may be deployed quickly and efficiently under adverse conditions. Moreover, the platform step may be positioned and will remain in the desired position without the necessity of handling small pins or threaded fasteners.

It is a feature of the invention that the platform may be utilized with the notches 15, 19 of only one support wall 14 in engagement with rungs 9, 11, respectively. Thus, if desireable, the walls may straddle a ladder rail 13, with surface 23 of one wall resting on the roof. A fire-fighter would find this arrangement particularly useful when he is cutting a hole in the roof with a power cutting tool; he could conveniently cut the hole higher on the roof than the step 25 and adjacent the ladder 5.

Without further description, it is thought that the advantages to be gained from the disclosed embodiment of my portable adjustable roof platform will be apparent to those skilled in the art. It is contemplated that various modifications and changes may be made to the portable adjustable roof platform of the present invention within the scope of the appended claims without departing from the spirit of the invention.

I claim:

1. A portable adjustable roof platform for use with a roof ladder comprising:

a generally U-shaped base having a flat frame portion and at least two supporting walls depending therefrom, each supporting wall terminating in a lower surface and being formed with an L-shaped notch opening onto the lower surface, the notch being sized slightly larger than a ladder rung, each supporting wall being formed with a generally rectangular notch opening onto the lower surface, the notch being sized substantially greater than a ladder rung and extending toward the flat frame portion and having a lower portion spaced from the L-shaped notch opening such that the openings of the L-shaped and rectangular notches receive corresponding ladder rungs simultaneously;

b. step means pivotally supported close to one end of the base;

c. a toggle mechanism linking the step means to the base and including a threaded support bar; and d. toggle actuating means connected to the base at the end opposite the step means pivotal support, so that actuating the toggle actuating means causes the step means to pivot relative to the base.

2. The portable adjustable roof platform of claim 1 wherein the toggle actuating means comprises:

a. a pivotable bearing block;

b. block support means attached to the base close to the end opposite the step means pivotal support;

c. an elongate screw having a lower end journalled for rotation free of translation within the bearing block and an unsupported upper end engaging cooperating threads in the support bar;

d. a pair of opposed thrust bearings mounted to the screw on opposite sides of the bearing block; and e. a handle attached to the screw, so that rotation of the handle translates the support bar to actuate the toggle mechanism thereby putting the screw in tension when the step means is opening relative to the base and when a weight is placed on the opened step means.

3. The portable adjustable roof platform of claim 2 wherein at least one thrust bearing comprises a thrust washer interposed between the bearing block and a nut threaded onto the screw.

4. A method of securing an adjustable roof platform to a roof ladder comprising the steps of:

a. securing the ladder to the roof;

b. providing a roof platform having a base formed with at least two substantially vertical side walls having lower surfaces, each side wall defining an L-shaped notch and a generally rectangular notch opening from the lower surface thereof, the L-shaped notch and the rectangular notch being spaced to receive corresponding rungs of the ladder simultaneously;

c. moving the platform perpendicular to the plane of the ladder rungs to receive corresponding rungs simultaneously in the L-shaped and rectangular notches; and d. moving the platform parallel to the plane of the ladder to hook the L-shaped notch to the corresponding rung while continuously engaging the rectangular notch with the corresponding rung.

* * * * *